US009850847B2

(12) United States Patent
Ishii

(10) Patent No.: US 9,850,847 B2
(45) Date of Patent: Dec. 26, 2017

(54) PISTON FOR INTERNAL COMBUSTION ENGINE

(71) Applicant: HINO MOTORS, LTD., Hino-shi (JP)

(72) Inventor: Mori Ishii, Hino (JP)

(73) Assignee: Hino Motors, Ltd., Hino-shi (JP)

( * ) Notice: Subject to any disclaimer, the term of this patent is extended or adjusted under 35 U.S.C. 154(b) by 44 days.

(21) Appl. No.: 14/778,417

(22) PCT Filed: Mar. 12, 2014

(86) PCT No.: PCT/JP2014/056468
§ 371 (c)(1),
(2) Date: Sep. 18, 2015

(87) PCT Pub. No.: WO2014/148331
PCT Pub. Date: Sep. 25, 2014

(65) Prior Publication Data

US 2016/0084195 A1 Mar. 24, 2016

(30) Foreign Application Priority Data

Mar. 21, 2013 (JP) ..... 2013-058058

(51) Int. Cl.
*F02F 3/22* (2006.01)

(52) U.S. Cl.
CPC ..... *F02F 3/22* (2013.01)

(58) Field of Classification Search
CPC ..... F02F 3/22; F01P 3/10; F16J 1/09
USPC ..... 123/193.6
See application file for complete search history.

(56) References Cited

U.S. PATENT DOCUMENTS 6,327,962 B1 * 12/2001 Kruse ..... F02F 3/003 92/186
2010/0218673 A1 9/2010 Ribeiro
2012/0234285 A1 * 9/2012 Venugopal ..... F02B 23/0651 123/193.6

FOREIGN PATENT DOCUMENTS

| | | | | | |
|---|---|---|---|---|---|
| CN | 1902392 | A | | 1/2007 | |
| CN | 102667127 | A | | 9/2012 | |
| JP | 60-187325 | | | 12/1985 | |
| JP | 62-17347 | A | | 1/1987 | |
| JP | 3-117657 | A | | 5/1991 | |
| JP | 2002-250251 | A | | 9/2002 | |
| JP | 2003-138984 | A | | 5/2003 | |
| JP | 2003138984 | A | * | 5/2003 | ..... F02F 3/22 |
| JP | 2007-146819 | A | | 6/2007 | |
| JP | 2007146819 | A | * | 6/2007 | ..... F02F 3/22 |
| JP | 2011-17263 | A | | 1/2011 | |
| JP | 2012-519251 | A | | 8/2012 | |

OTHER PUBLICATIONS

International Search Report dated Jun. 17, 2014 in PCT/JP2014/056468.

(Continued)

*Primary Examiner* — Carlos A Rivera
*Assistant Examiner* — Anthony Taylor, Jr.
(74) *Attorney, Agent, or Firm* — Oblon, McClelland, Maier & Neustadt, L.L.P.

(57) ABSTRACT

A piston includes a combustion chamber that is formed at a piston top surface and an oil gallery that is formed so as to surround the combustion chamber. Wall thickness from a sliding side surface of the piston to the oil gallery is set greater on a piston skirt side than on a piston top surface side.

3 Claims, 6 Drawing Sheets

(56) References Cited

OTHER PUBLICATIONS

International Preliminary Report on Patentability and Written Opinion dated Oct. 1, 2015 in PCT/JP2014/056468.
Combined Office Action and Search Report dated Feb. 22, 2017 in Chinese Patent Application No. 201480016746.X (with English translation of categories of cited documents).
Office Action dated Aug. 29, 2017, in Japanese Patent Application No. 2014-058433 (with English-language translation).

* cited by examiner

PISTON FOR INTERNAL COMBUSTION ENGINE

TECHNICAL FIELD

An aspect of the present invention relates to a piston for an internal combustion engine.

BACKGROUND ART

As a technical literature on a conventional piston for an internal combustion engine, Patent Literature 1 is known. This literature discloses a piston having a combustion chamber that is formed at a piston top surface and an oil gallery that is formed so as to surround the combustion chamber.

CITATION LIST

Patent Literature

[Patent Literature 1] Japanese Patent Application Laid Open Publication No. 2011-17263

SUMMARY OF INVENTION

Technical Problem

In recent years, internal combustion engines have been downsized, and high pressure injection of fuel is used to obtain sufficient output while achieving the downsizing. However, when the high pressure injection of fuel raises the combustion temperature higher, the temperature on the side of a piston top surface and the temperature on the side of a piston skirt may become significantly different, whereby deformation of the piston due to the temperature difference may occur. When a piston ring groove is deformed in the piston, the resulting malfunction of the piston ring may problematically cause seizing or reduced sealing performance.

In view of this, an aspect of the present invention aims to provide a piston for an internal combustion engine that makes it possible to prevent deformation of the piston due to temperature difference.

Solution to Problem

To solve the above-described problems, a piston according to an aspect of the present invention includes a combustion chamber that is formed at a piston top surface and an oil gallery that is formed so as to surround the combustion chamber. Wall thickness from a sliding side surface of the piston to the oil gallery is set greater on a piston skirt side than on a piston top surface side.

In the piston according to an aspect of the present invention for an internal combustion engine, the wall thickness from the sliding side surface of the piston to the oil gallery is set to be greater on the piston skirt side than on the piston top surface side. This setting makes it possible to prevent the piston skirt side in which temperature rise due to combustion is small from being excessively cooled while the piston top surface side in which temperature rise due to combustion is large can be sufficiently cooled by engine oil flowing in the oil gallery. Accordingly, the temperature difference between the piston top surface side and the piston skirt side can be reduced, whereby deformation of the piston can be prevented.

In the piston according to an aspect of the present invention for an internal combustion engine, the oil gallery may have an outer inclined surface that approaches closer to a piston central axis the closer it is to the piston skirt side with respect to the piston top surface side.

In the piston according to an aspect of the present invention for an internal combustion engine, an inner side surface of the oil gallery may be formed along a side wall of the combustion chamber.

In the piston according to an aspect of the present invention for an internal combustion engine, the side wall of the combustion chamber may have a lip portion that protrudes inside the combustion chamber, and the inner side surface of the oil gallery may have an inner enlarged surface that extends toward the lip portion.

Advantageous Effects of Invention

A piston according to an aspect of the present invention for an internal combustion engine makes it possible to prevent deformation of the piston due to temperature difference.

DESCRIPTION OF EMBODIMENTS

Preferred embodiments of the present invention will be described hereinafter in detail with reference to the drawings.

First Embodiment

Figure 1:
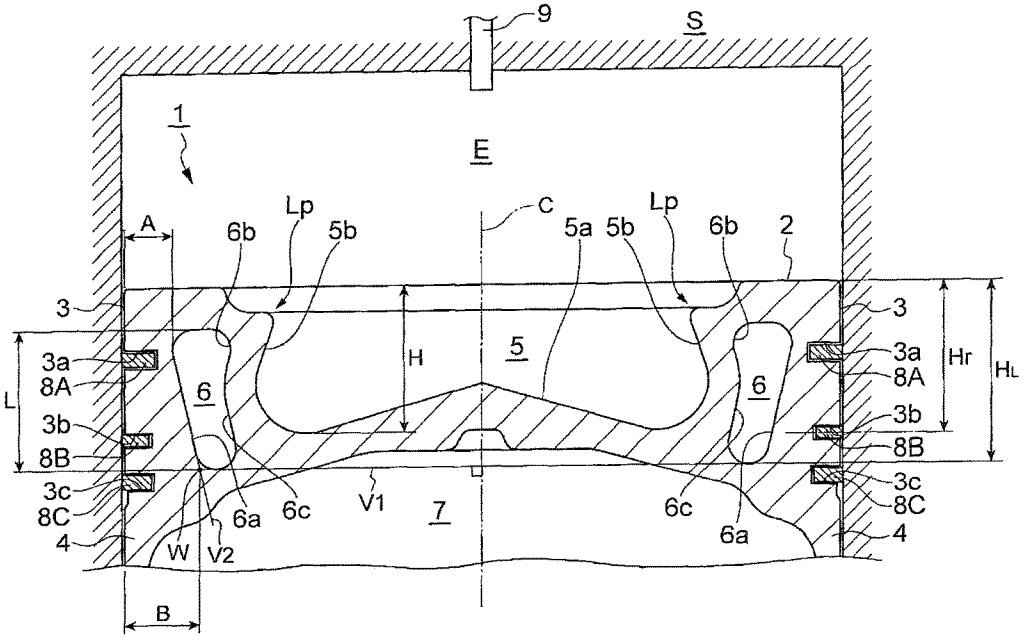
FIG. 1 is a sectional view illustrating a piston according to a first embodiment.

As depicted in FIG. 1, a piston 1 according to a first embodiment is provided to an internal combustion engine such as a diesel engine of a vehicle, and reciprocates inside a cylinder S in an extending direction of a central axis (piston central axis) C. The piston 1 is connected to a crankshaft of the internal combustion engine with a connecting rod, and the reciprocating motion energy of the piston 1 is converted to the rotational energy of the crankshaft with the connecting rod. Illustration of the connecting rod and the crankshaft is omitted herein.

The piston 1 includes a piston top surface 2, a sliding side surface 3, and a piston skirt 4. It is assumed in the following description that, in the piston 1, the side of the piston top surface 2 is the upper side and the side of the piston skirt 4 is the lower side.

The piston top surface 2 is a piston upper-end surface that forms a space E for combustion in the cylinder S. When the internal combustion engine is driving, fuel injected by a fuel injector 9 is burned in the space E, whereby the piston top surface 2 is heated to a high temperature. The piston 1 has a combustion chamber 5.

The sliding side surface 3 is a piston side surface that slides over the inner side surface of the cylinder S. On the sliding side surface 3, piston ring grooves 3*a* to 3*c* are formed into which piston rings 8A to 8C are fitted, respectively.

The first piston ring 8A positioned closest to the side of the piston top surface 2 is arranged in the first piston ring groove 3*a*. The second piston ring 8B positioned between the first piston ring groove 3*a* and the third piston ring groove 3*c* is arranged in the second piston ring groove 3*b*. The third piston ring 8C positioned closest to the side of the piston skirt 4 is arranged in the third piston ring groove 3*c*.

The piston skirt 4 is a skirt-like portion that is formed so as to extend downward along the sliding side surface 3. In an inner space 7 of this piston skirt 4, the small end of the connecting rod is arranged.

The combustion chamber 5 is a space that is part of the space E in which fuel mixed with air burns and is a space formed on the side of the piston 1. The combustion chamber 5 has a bottom surface 5*a* and a side wall 5*b*. The bottom surface 5*a* is formed so as to be more inclined upward in a position closer to the center (central axis C), for example. This combustion chamber 5 is a reentrant-type combustion chamber in which the side wall 5*b* is inclined toward the inside (side of the central axis C). On the upper side of the combustion chamber 5, a lip portion Lp that is a portion of the side wall 5*b* most protruding inward is formed. Herein, the combustion chamber 5 is not limited to the reentrant-type, and may be a toroidal-type combustion chamber in which the side wall 5*b* is formed vertically along the central axis C, or may be a bathtub-type combustion chamber in which the side wall 5*b* is formed vertically and the bottom surface 5*a* is formed planarly.

The piston 1 also has an oil gallery 6 that is formed in a ring-shaped manner so as to surround the combustion chamber 5 (around the central axis C). The oil gallery 6 is a hollow portion that is formed inside the piston 1, and engine oil flows therein through an oil jet hole (not depicted), thereby cooling the piston 1.

The cross sectional shape of this oil gallery 6 along the central axis C (cross sectional shape depicted in FIG. 1) is substantially oval. Specifically, the oil gallery 6 has an outer inclined surface 6*a*, an inner enlarged surface 6*b*, and an inner inclined surface 6*c*.

The outer inclined surface 6*a* is an outer side surface (side surface away from the combustion chamber 5) of the oil gallery 6. The outer inclined surface 6*a* is formed as a flat surface that approaches closer to the central axis C the closer it is to piston skirt 4 side with respect to piston top surface 2 side. In other words, the outer inclined surface 6*a* inclines away from the sliding side surface 3 toward the lower side. The outer inclined surface 6*a* is formed in the oil gallery 6 on the side of the sliding side surface 3 (away from the central axis C) of the piston 1. Alternatively, the outer inclined surface 6*a* may be a curved surface, or may include both of a flat surface and a curved surface.

The inner enlarged surface 6*b* and the inner inclined surface 6*c* form an inner side surface (side surface closer to the combustion chamber 5) of the oil gallery 6, and are formed along the side wall 5*b* of the combustion chamber 5. In other words, the inner side surface of the oil gallery 6 is formed along the side wall 5*b* of the combustion chamber 5.

The inner enlarged surface 6*b* is formed on the upper side of the oil gallery 6 (on the side of the piston top surface 2). The inner enlarged surface 6*b* is a portion of the inner side surface for enlarging the oil gallery 6 toward the side of the combustion chamber 5 (closer to the central axis C). In other words, inner enlarged surface 6*b* is formed extending toward the side of the combustion chamber 5. Specifically, the inner enlarged surface 6*b* is formed so as to extend toward the lip portion Lp that protrudes most toward the central axis C in the side wall 5*b* of the combustion chamber 5. The inner enlarged surface 6*b* is formed so that wall thickness between the inner side surface of the oil gallery 6 and the side wall 5*b* of the combustion chamber 5 is more uniform than the wall thickness without the inner enlarged surface 6*b*. The wall thickness between the inner side surface of the oil gallery 6 and the side wall 5*b* of the combustion chamber 5 is sufficient in thickness to ensure strength.

The inner inclined surface 6*c* is a flat surface that is formed on the lower side (side of the piston skirt 4) of the inner side surface of the oil gallery 6 and is inclined substantially parallel to the outer inclined surface 6*a*. The inner inclined surface 6*c* is formed being inclined along the side wall 5*b* of the combustion chamber 5.

In this oil gallery 6, assuming that the length thereof in the extending direction of the central axis C is denoted by L, and the upper effective wall thickness and the lower effective wall thickness in the wall thickness from the sliding side surface 3 of the piston 1 to the oil gallery 6 in the direction orthogonal to the central axis C are respectively denoted by A and B, the oil gallery 6 satisfies the following expressions (1) and (2). In the expression (2), H denotes the depth of the combustion chamber 5 depicted in FIG. 1 (distance from the piston top surface 2 to the bottommost surface of the combustion chamber 5).

[Mathematical 1]

$$\frac{B-A}{L} \geq 0.05 \tag{1}$$

$$L \geq 0.65H \tag{2}$$

The upper effective wall thickness A in the present embodiment means the smallest wall thickness from the sliding side surface 3 of the piston 1 to the oil gallery 6 on the side of the piston top surface 2. The lower effective wall thickness B in the present embodiment means the wall thickness from the sliding side surface 3 of the piston 1 to the intersection point W. In the cross section depicted in FIG. 1, the intersection point W denotes the point of intersection between the virtual line V1 that passes through the lower end of the oil gallery 6 and is orthogonal to the central axis C (that is the same as lower one of the dimension lines indicated with L in FIG. 1) and the extended line V2 extending along the outer inclined surface 6*a*.

Figure 2:
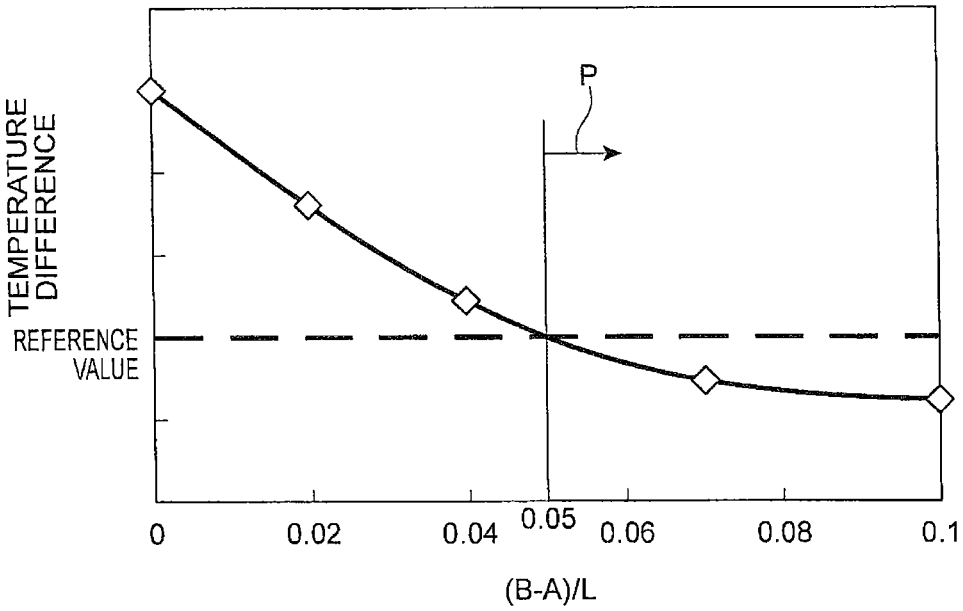
FIG. 2 is a graph illustrating an example of temperature difference in the piston versus (B−A)/L.

FIG. 2 is a graph illustrating an example of temperature difference in the piston 1 versus (B−A)/L described above. The vertical axis in FIG. 2 represents temperature difference between the vicinity of the first piston ring 8A on the side of the piston top surface 2 and the vicinity of the third piston ring 8C on the side of the piston skirt 4. The horizontal axis in FIG. 2 represents (B−A)/L.

As depicted in FIG. 2, the temperature difference in the piston 1 decreases as the value of (B−A)/L increases. In the present embodiment, to control deformation of the piston 1 due to the temperature difference at or below a reference value, (B−A)/Lq is set to be 0.05 or more. The range in which (B−A)/Lq is 0.05 or more is indicated by the arrow P. FIG. 2 is merely one example illustrating temperature difference in the piston 1 versus (B−A)/L, and the present invention is not limited to the description above.

In the piston 1 for an internal combustion engine according to the above-described first embodiment, the wall thickness from the sliding side surface 3 to the oil gallery 6 is set greater on the side of the piston skirt 4 than on the side of the piston top surface 2. This setting makes it possible to prevent the side of the piston skirt 4 in which temperature rise due to combustion is small from being excessively cooled while the side of the piston top surface 2 in which temperature rise due to combustion is large can be sufficiently cooled by oil flowing in the oil gallery 6. Accordingly, the temperature difference between the side of the piston top surface 2 and the side of the piston skirt 4 can be reduced, whereby deformation of the piston 1 can be prevented. Thus, this piston 1 makes it possible to prevent seizing or reduced sealing performance due to malfunction of the piston rings 8A to 8C resulting from deformation of the piston ring grooves 3*a* to 3*c*. Thus, reliability and sealing performance of the piston rings 8A to 8C can be improved, whereby the blowby amount can be reduced.

In this piston 1, the oil gallery 6 has the outer inclined surface 6*a* that approaches closer to the central axis C the closer it is to piston skirt 4 side with respect to piston top surface 2 side. This shape of the oil gallery 6, not the piston shape, enables the wall thickness from the sliding side surface 3 to the oil gallery 6 in the piston 1 to be set greater toward the lower side, making it possible to prevent the side of the piston skirt 4 from being excessively cooled by the oil flowing in the oil gallery 6.

As depicted in FIG. 1, in the piston 1, the distance $H_L$ from the piston top surface 2 to the lower end of the oil gallery 6 is longer than the distance Hr from the piston top surface 2 to the second piston ring groove 3*b* (i.e., to the second piston ring 8B). Specifically, the oil gallery 6 is formed so as to extend perpendicularly from the upper side of the first piston ring groove 3*a* to the vicinity of the third piston ring groove 3*c* beyond the second piston ring groove 3*b*. This makes it possible to suitably obtain the cooling effect of the oil flowing in the oil gallery 6 even in the second piston ring groove 3*b* and the third piston ring groove 3*c*.

Furthermore, in this piston 1, the inner enlarged surface 6*b* that extends toward the lip portion Lp at the combustion chamber 5 is formed in the oil gallery 6, whereby the lip portion Lp at the combustion chamber 5 can be suitably cooled. Specifically, in the reentrant-type combustion chamber 5, flows of air and fuel mixed with the air are suitably tuned by providing the lip portion Lp, whereby the combustion efficiency in the combustion chamber 5 can be increased. However, the lip portion Lp most protruding in the side wall 5*b* of the combustion chamber 5 is likely to be affected by heat concentration. In the piston 1 according to the present embodiment, the oil gallery 6 has the inner enlarged surface 6*b* that is recessed toward the lip portion Lp. Accordingly, the lip portion Lp can be suitably cooled by the oil flowing in the oil gallery 6.

Furthermore, in this piston 1, because the inner side surface (the inner enlarged surface 6*b* and the inner inclined surface 6*c*) of the oil gallery 6 is formed along the side wall 5*b* of the combustion chamber 5, the wall thickness of the piston 1 between the side wall 5*b* of the combustion chamber 5 and the inner side surface of the oil gallery 6 can be made more uniform. This makes it possible to prevent temperature distribution in the side wall 5*b* from becoming non-uniform by cooling with oil as contrasted with when the wall thickness between the inner side surface of the oil gallery 6 and the side wall 5*b* of the combustion chamber 5 is not uniform. Thus, in this piston 1, it is possible to prevent deformation of the piston 1 due to temperature difference that is caused by non-uniform temperature distribution in the piston 1 resulting from non-uniform air temperature distribution in the combustion chamber 5 originating from non-uniform temperature distribution in the side wall 5*b*. It is also possible to prevent reduction of combustion efficiency in the combustion chamber 5.

Second to Fourth Embodiments

Figure 3:
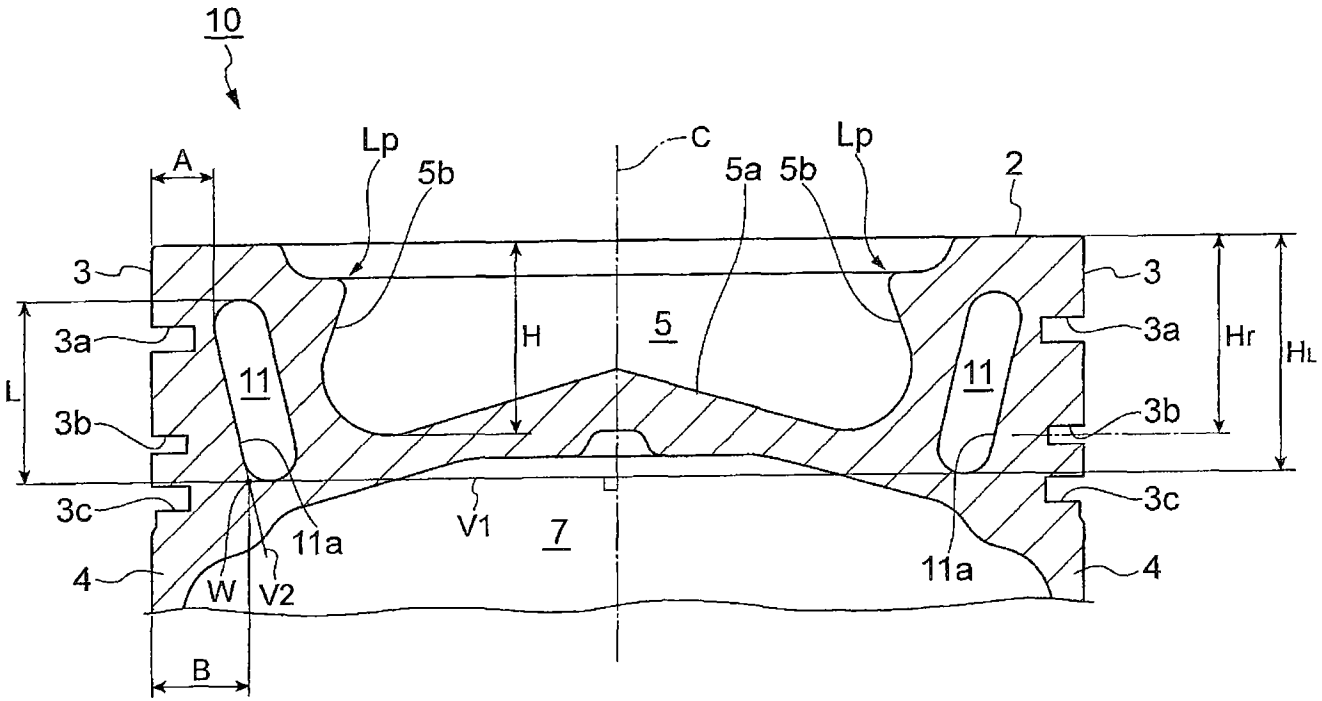
FIG. 3 is a sectional view illustrating a piston according to a second embodiment.
Figure 4:
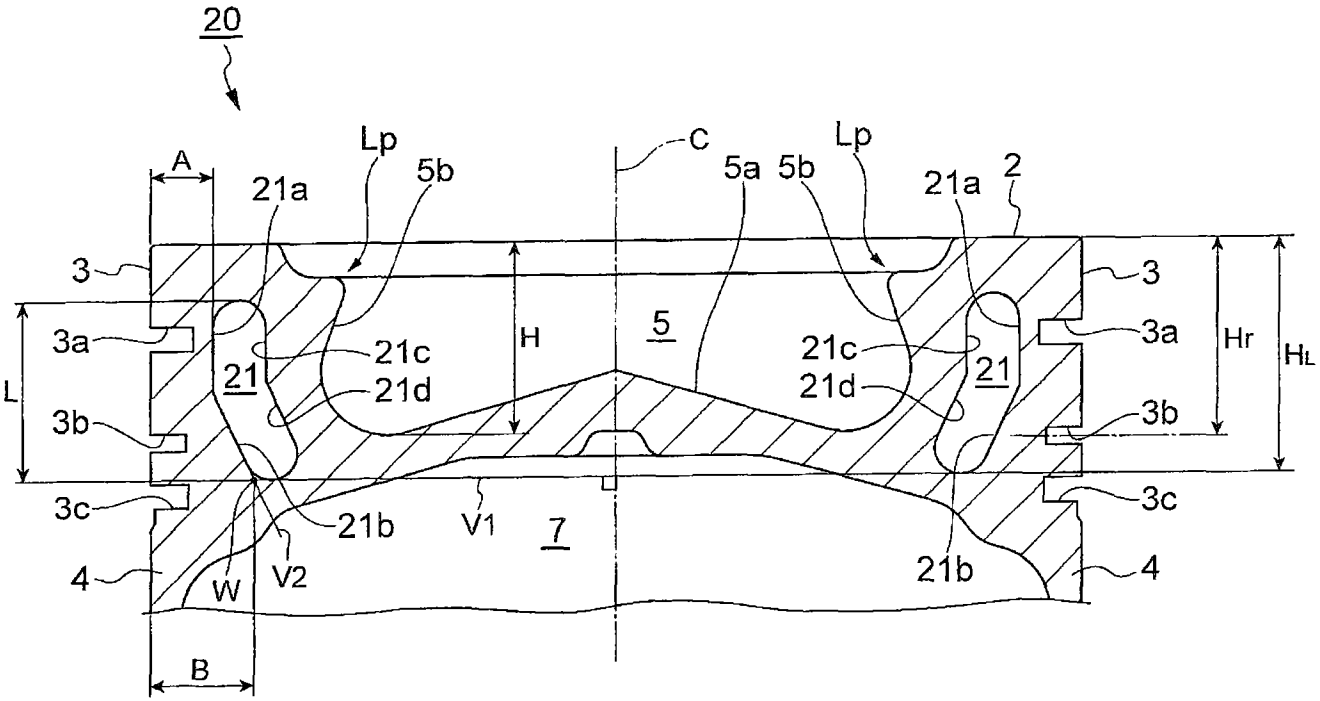
FIG. 4 is a sectional view illustrating a piston according to a third embodiment.
Figure 5:
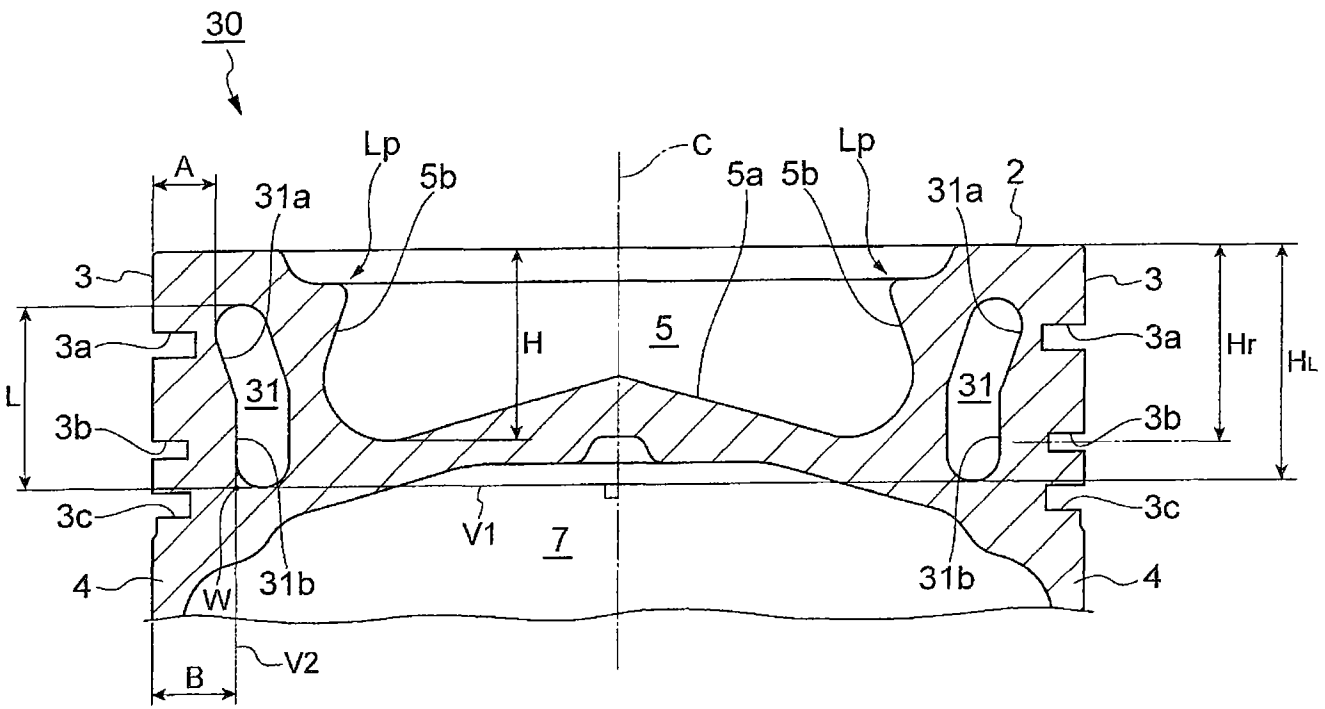
FIG. 5 is a sectional view illustrating a piston according to a fourth embodiment.

The following describes second to fourth embodiments with reference to FIG. 3 to FIG. 5. Pistons 10, 20, and 30 according to the second to the fourth embodiments are different only in shape of oil galleries from the piston 1 according to the first embodiment. Hereinafter, the same reference numerals are given to the same or equivalent components in the respective drawings, and repetitive description will not be made.

The oil gallery 11 of the piston 10 according to the second embodiment depicted in FIG. 3 has an oval cross sectional shape (cross sectional shape along the central axis C). The oil gallery 11 has an outer inclined surface 11*a* in the same manner as the first embodiment, but does not have a portion like the inner enlarged surface 6*b*. The inner side surface of the oil gallery 11 is an inclined surface along the outer inclined surface 11*a*.

The oil gallery 11 satisfies the above-described expressions (1) and (2), also in terms of the length L in the extending direction of the central axis C, and the upper effective wall thickness A and the lower effective wall thickness B in the wall thickness from the sliding side surface 3 of the piston 1 to the oil gallery 11, in the same manner as the first embodiment.

The second embodiment is the same as the first embodiment also in that the distance $H_L$ from the piston top surface 2 to the lower end of the oil gallery 11 is longer than the distance Hr from the piston top surface 2 to the second piston ring groove 3*b* (i.e., to second piston ring 8B). The third and the fourth embodiments are also the same as the first embodiment in that the length L in the extending direction of the central axis C, the upper effective wall thickness A, and the lower effective wall thickness B satisfy the above-described expressions (1) and (2) and in that the distance $H_L$ is longer than the distance Hr.

The following describes the piston 20 according to the third embodiment depicted in FIG. 4. As depicted in FIG. 4, an oil gallery 21 of the piston 20 according to the third embodiment has a cross sectional shape (cross sectional shape along the central axis C) in which the lower side of an oval extending in the extending direction of the central axis C bends slightly toward the central axis C.

This oil gallery 21 also has an outer vertical surface 21*a* on the upper side and an outer inclined surface 21*b* on the lower side. The outer vertical surface 21*a* and the outer inclined surface 21*b* form the outer side surface of the oil gallery 21. The outer vertical surface 21*a* and the outer inclined surface 21*b* are formed in the oil gallery 21 on the side of the sliding side surface 3 (away from the central axis C). The outer vertical surface 21*a* is a flat surface that extends in the extending direction of the central axis C, and the outer inclined surface 21*b* is a flat surface that inclines closer to the central axis C toward the lower side. Alternatively, the outer vertical surface 21*a* and the outer inclined surface 21*b* may be curved surfaces, or may include a flat surface and a curved surface. The oil gallery 21 also has an inner vertical surface 21*c* on the upper side and an inner inclined surface 21*d* on the lower side. The inner vertical surface 21*c* and the inner inclined surface 21*d* form the inner side surface of the oil gallery 21.

The following describes the piston 30 according to the fourth embodiment depicted in FIG. 5. As depicted in FIG. 5, an oil gallery 31 of the piston 30 according to the fourth embodiment has a cross sectional shape (cross sectional shape along the central axis C) in which the upper side of an oval extending in the extending direction of the central axis C bends slightly toward the side of the sliding side surface 3 (away from the central axis C).

This oil gallery 31 also has an outer inclined surface 31*a* on the upper side and an outer vertical surface 31*b* on the lower side. The outer inclined surface 31*a* and the outer vertical surface 31*b* are formed in the oil gallery 31 on the side of the sliding side surface 3 (away from the central axis C). The outer inclined surface 31*a* is a flat surface inclines closer to the central axis C toward the lower side, and the outer vertical surface 31*b* is a flat surface that extends in the extending direction of the central axis C. Alternatively, the outer inclined surface 31*a* and the outer vertical surface 31*b* may be curved surfaces, or may include a flat surface and a curved surface.

In the above-described pistons 10, 20, and 30 according to the second to the fourth embodiments, the wall thicknesses from the sliding side surface 3 to the oil galleries 11, 21, and 31 are also set greater on the side of the piston skirt 4 than on the side of the piston top surface 2. Thus, the same effect as in the piston 1 according to the first embodiment can be obtained.

Fifth Embodiment

Figure 6:
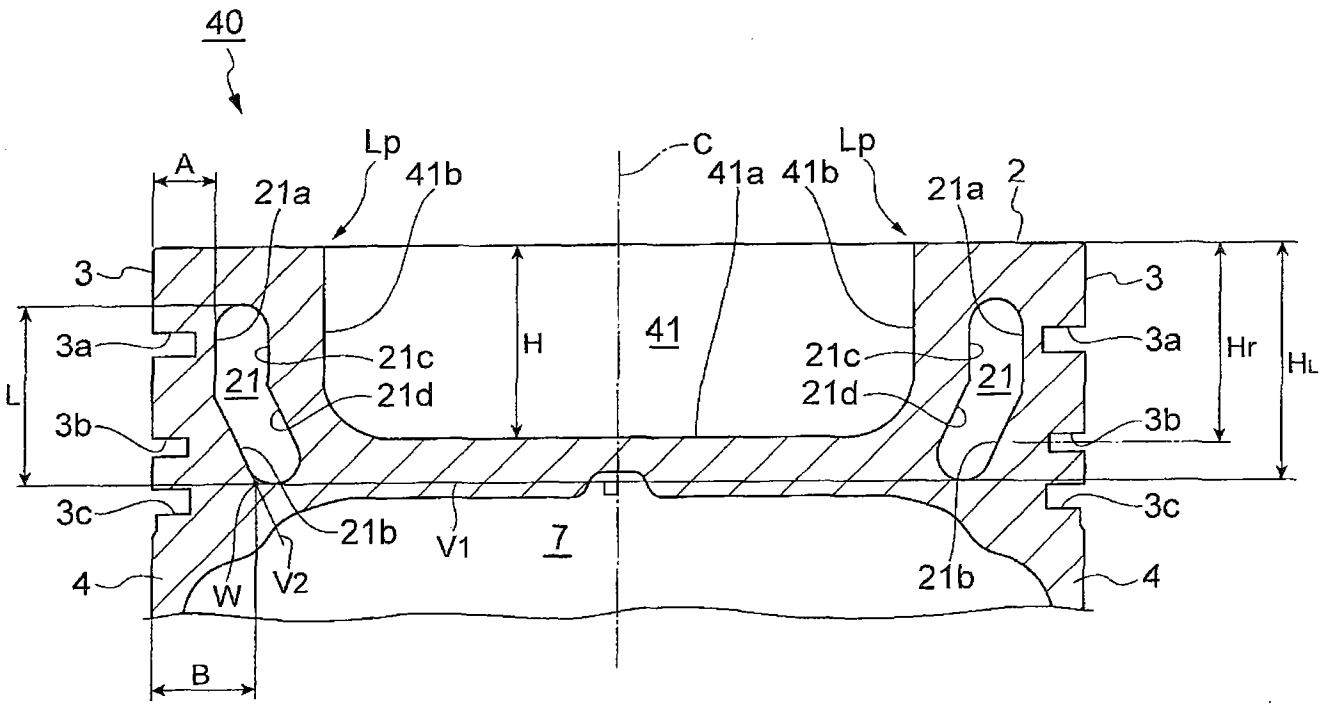
FIG. 6 is a sectional view illustrating a piston according to a fifth embodiment.

The following describes a fifth embodiment with reference to FIG. 6. A piston 40 according to the fifth embodiment is different only in shape of the combustion chamber from the piston 20 according to the third embodiment.

The combustion chamber 41 of the piston 40 according to the fifth embodiment depicted in FIG. 6 is what is called a bathtub-type combustion chamber. The combustion chamber 41 has a bottom surface (bottom surface substantially parallel to the piston top surface 2) 41*a* orthogonal to the central axis C and a side wall (side wall substantially orthogonal to the piston top surface 2) 41*b* extending along the central axis C. Alternatively, the bottom surface 41*a* may be formed so as to be more inclined upward in a position closer to the center (central axis C), for example. In this combustion chamber 41, the upper end of the opening of the combustion chamber 41 formed at the piston top surface 2 corresponds to the lip portion Lp.

In this piston 40, the inner vertical surface 21*c* of the oil gallery 21 is formed along the side wall 41*b* of the combustion chamber 41. Furthermore, the inner inclined surface 21*d* of the oil gallery 21 is inclined along a connection portion between the bottom surface 41*a* and the side wall 41*b* of the combustion chamber 41.

As the inner vertical surface 21*c* of the oil gallery 21 is formed along the side wall 41*b* of the combustion chamber 41 also in the above-described piston 40 according to the fifth embodiment, the wall thickness of the piston 40 between the side wall 41*b* of the combustion chamber 41 and the inner side surface of the oil gallery 21 can be made more uniform. It is thus possible to avoid non-uniformity in the temperature distribution in the side wall 41*b* due to cooling of the oil, in comparison to when the thickness between the inner side wall of oil gallery 21 and the side wall 41*b* of the combustion chamber 41 is not uniform. Therefore, from this piston 40, in addition to making it possible to prevent the deformation of the piston 40 from the temperature difference, as caused by the temperature distribution of air in the combustion chamber 41 becoming non-uniform due to the temperature distribution in the side wall 41*b* becoming non-uniform, along with non-uniformity also in the temperature distribution of the piston 40, it is also possible to prevent the reduction of combustion efficiency in the combustion chamber 41.

Hereinbefore, preferred embodiments of the present invention have been described, but the present invention is not limited to the above-described embodiments.

For example, an aspect of the present invention may be applied to pistons for gasoline engines instead of the above-described pistons exclusively for diesel engines. Furthermore, the shapes of the oil galleries are not limited to those described above, and any shape may be used as long as the wall thickness from the sliding side surface of the piston to the oil gallery may be set greater on the side of the piston skirt than on the side of the piston top surface.

Furthermore, the oil galleries do not have to extend to below the position of the second piston ring groove, and the lower ends of the oil galleries may be positioned above the second piston ring groove. Furthermore, the outer inclined surfaces of the oil galleries do not have to be inclined smoothly, and may have steps, for example. Furthermore, in the first embodiment, if deformation of the piston 1 due to temperature difference does not occur that is caused by non-uniform temperature distribution in the piston 1 resulting from non-uniform temperature distribution in the side wall 5*b*, the inner enlarged surface 6*b* may be formed so that the wall thickness between the inner side surface of the oil gallery 6 and the side wall 5*b* of the combustion chamber 5 is not completely uniform but more uniform than the wall thickness without the inner enlarged surface 6*b*.

INDUSTRIAL APPLICABILITY

According to an aspect of the present invention, a piston for an internal combustion engine can be provided that makes it possible to prevent deformation of the piston due to temperature difference.

REFERENCE SIGNS LIST

1 . . . piston, 2 . . . piston top surface, 3 . . . sliding side surface, 3*a* . . . first piston ring groove, 3*b* . . . second piston ring groove, 3*c* . . . third piston ring groove, 4 . . . piston skirt, 5, 41 . . . combustion chamber, 5*a*, 41*a* . . . bottom surface, 5*b*, 41*b* . . . side wall, 6*a* . . . outer inclined surface, 6*b* . . . inner enlarged surface, 6*c* . . . inner inclined surface, 7 . . . inner space, 8A . . . piston ring, 8B . . . piston ring, 8C . . . piston ring, 9 . . . fuel injector, 1, 10, 20, 30, 40 . . . piston, 6, 11, 21, 31 . . . oil gallery, 11*a*, 21*b*, 31*a* . . . outer inclined surface, 21*a*, 31*b* . . . outer vertical surface, 21*c* . . . inner vertical surface, 21*d* . . . inner inclined surface, A . . . upper effective wall thickness, B . . . lower effective wall thickness, C . . . central axis (piston central axis), E . . . space, S . . . cylinder, V1 . . . virtual line, V2 . . . extended line, W . . . intersection point.

The invention claimed is:

1. A piston of an internal combustion engine comprising:

a combustion chamber that is formed at a piston top surface; and an oil gallery that is formed so as to surround the combustion chamber, wherein a wall thickness from a sliding side surface of the piston to the oil gallery is set greater on a piston skirt side than on a piston top surface side, wherein the oil gallery includes an outer surface and a curved bottom surface, the outer surface approaching a piston central axis in a cross section along the piston central axis, as the outer surface extends from the piston top surface side to the curved bottom surface on the piston skirt side, and wherein $(B-A)/L \geq 0.05$ is satisfied, in a cross section along the piston central axis, where a length of the oil gallery in an extending direction of the piston central axis is L, a lowest wall thickness from the sliding side surface to the piston top surface of the oil gallery is A, and a wall thickness from the sliding side surface to an intersection point W is B, where the intersection point W is a point of intersection between a virtual line V1 passing through a lower end of the oil gallery and orthogonal to the piston central axis and an extended line V2 extending along the outer surface immediately above the curved bottom surface.

2. The piston of an internal combustion engine according to claim 1, wherein an inner side surface of the oil gallery is formed along a side wall of the combustion chamber.

3. The piston of an internal combustion engine according to claim 2, wherein the side wall of the combustion chamber has a lip portion that protrudes inside the combustion chamber, and the inner side surface of the oil gallery has an inner enlarged surface that extends toward the lip portion.

* * * * *